United States Patent [19]

Dahlman et al.

[11] 3,992,837

[45] Nov. 23, 1976

[54] PRESS STAND

[75] Inventors: Goran Dahlman; Sten Nilsson, both of Helsingborg, Sweden

[73] Assignee: Allmanna Svenska Elektriska Aktiebolaget, Vasteras, Sweden

[22] Filed: July 3, 1975

[21] Appl. No.: 593,050

[30] Foreign Application Priority Data

July 29, 1974 Sweden ..... 7409757

[52] U.S. Cl. ..... 52/223 R; 72/455

[51] Int. Cl.[2] ..... B30B 1/00

[58] Field of Search ..... 100/214; 72/455

[56] References Cited

UNITED STATES PATENTS

| | | | |
|---|---|---|---|
| 3,064,558 | 11/1962 | Von Platen | 100/214 |
| 3,210,837 | 10/1965 | Hassellof | 100/214 X |
| 3,508,429 | 4/1970 | Staples | 100/214 X |
| 3,687,066 | 8/1972 | Von Platen et al. | 100/214 |
| 3,717,024 | 2/1973 | Davison | 100/214 X |
| 3,805,584 | 4/1974 | Nilsson | 100/214 X |
| 3,884,142 | 5/1975 | Jonsson | 100/214 |

*Primary Examiner*—J. Karl Bell

*Attorney, Agent, or Firm*—Watson, Cole, Grindle & Watson

[57] ABSTRACT

A press stand which is formed of two yokes, two pillars and a pre-stressed sheath of strap or wire wound around the yokes and pillars for holding them together and taking up forces acting on the inner surface of the yokes in which the yokes comprise a bow-shaped outer portion and a substantially semi-cylindrical fill-up portion held in place by side plates fixed to the stand.

3 Claims, 4 Drawing Figures

PRESS STAND

BACKGROUND OF THE INVENTION

1. Field of the Invention

The present invention relates to a press stand of the kind which is built up of two yokes and two pillars which are held together by a prestressed strip or wire sheath which takes up the forces acting on the surfaces of the yoke facing each other. Press stands of this kind are described in more detail in U.S. Pat. No. 3,064,558. The press stand according to the invention is primarily suited for use in press equipment for treating products under high hydrostatic gas or liquid pressure, where the stand mainly takes up only the forces which a gas or a liquid exerts on the end closure of a pressure chamber, for example press equipment of the type described in more detail in U.S. Pat. Nos. 3,550,199 and 3,628,779.

2. The Prior Art

In known press stands the yokes have a substantially semicircular cross-section and consist of half-cylinders which form beams laid on the pillars of the press stand. At the middle of the yokes tensile stresses occur because of the prestressing forces in the strip sheath when the stand is unloaded. Because of the size of the yokes, it is expensive to manufacture them from forgings, and it is therefore desirable from the point of view of manufacture to make them of castings. However, such castings have less good physical properties than forgings, particularly with regard to fatigue strength, which will limit the permissible stress or the duration of the stress.

SUMMARY OF THE INVENTION

According to the invention, the previous construction with semi-cylindrical yokes is avoided. The yokes are made in two parts, one outer bow-shaped part suitably with substantially the same cross-section as the pillars between the yokes, and one filling portion shaped as a half cylinder, the plane surface of which constitutes the load-absorbing surface of the press stand. The filling portion can be fixed to the press by means of side plates at the ends of the yokes or by support bars at the inner sides of the pillars.

In the press according to the invention, the prestressing forces in the strip sheath of the press are taken up in a more favorable manner in pillars and yokes. The bow-shaped yoke portion takes up the forces as an arch and the material is substantially only exposed to compressive stresses. The choice of material is therefore made easier. The curved portion of the yoke can be easily made by bending a sheet, and a sufficiently high-strength material can be utilized. In many cases it is possible to use sheets with dimensions which are available on the market. It is also possible to utilize cast materials. The fill-up portion can be made of castings.

BRIEF DESCRIPTION OF THE DRAWINGS

The invention is described in more detail with reference to the accompanying drawing.

DESCRIPTION OF THE PREFERRED EMBODIMENTS

Figure 1:
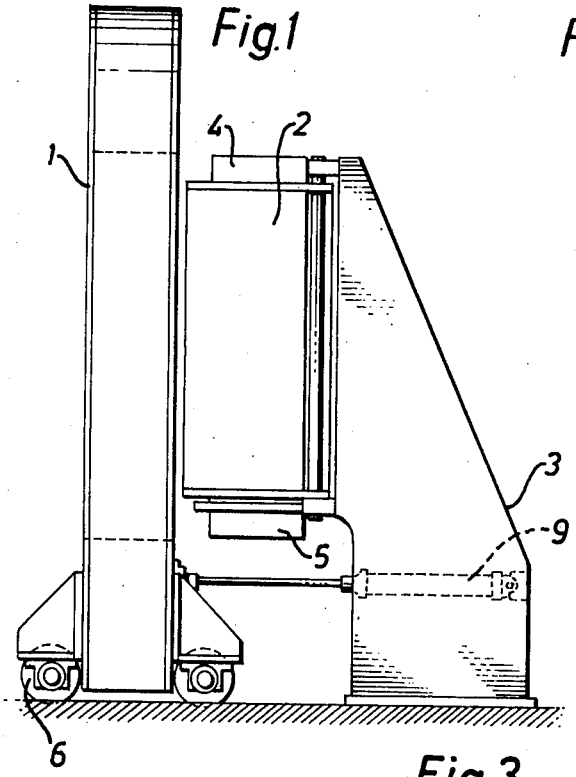
FIGS. 1 and 2 show two views of press equipment, where the press stand according to the invention is included.
Figure 2:
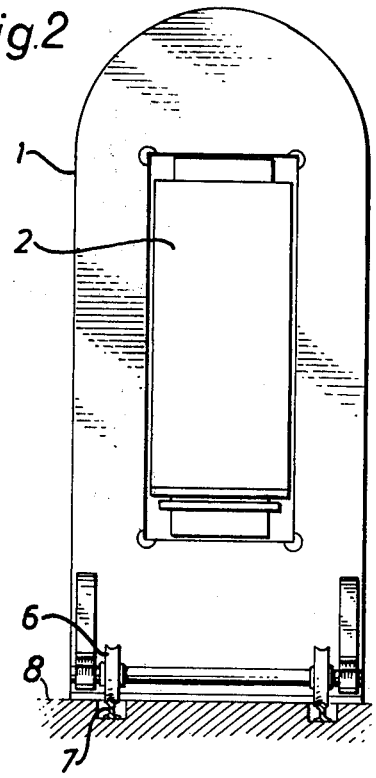
Figure 3:
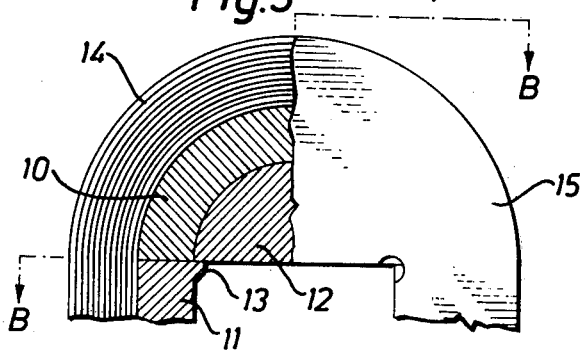
FIG. 3 partly a view of, partly a section through the upper part of a press stand, on the line A — A in FIG. 4.
Figure 4:
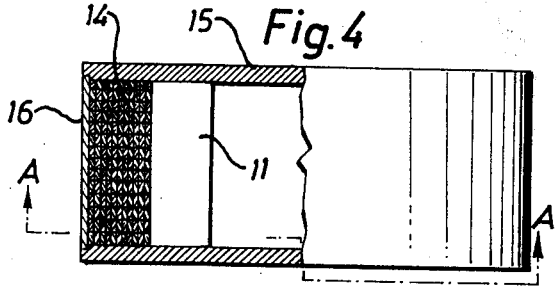
FIG. 4 partly a view of, partly a section through the press stand at the boundary between yokes and pillars, on the line B — B in FIG. 3.

FIGS. 1 and 2 show a press stand 1 adapted for a plant for isostatic compression of parts in a high pressure chamber 2 which is supported by a pillar 3. The press stand 1 is intended to take up the axial forces arising through the pressure in the pressure chamber, which endeavor to push end closures 4 and 5 out of the pressure chamber. The press stand is supported by a wheel 6 running on rails 7 in the floor 8. The press stand is moved between a charging position, in which it is located at the side of the very high pressure chamber — so that the upper end closure can be removed, thus allowing the pressure chamber to be charged — and a pressing position where the press stand surrounds the pressure chamber, with the help of a hydraulic cylinder 9. The pressure chamber may have a length of from three to four meters, and the press stand will therefore have a considerable height. As is illustrated best in FIGS. 3 and 4, the press stand contains two yokes consisting of a bow-shaped portion 10 resting on the pillars 11 and a semi-cylindrical fill-up portion 12 which is held fixed to the portion 10 by ribs 13 at the ends of the pillars 11. The yokes and pillars are surrounded by a prestressed strip sheath 14. The reaction force is taken up as the compressive force in the pillars 11 and the curved portion 10 of the yoke. The stand is provided with end plates 15 and a cover plate 16 around the strip sheath. The fill-up portion 12 can also be fixed to the stand by attaching it to the end plates 15.

We claim:

1. Press stand containing two-part yokes, two pillars and a prestressed sheath of strip or wire wound around the yokes and the pillars, said sheath holding the yokes and pillars together and taking up forces acting on the inner surfaces of the yokes, in which the yokes each comprise a bow-shaped outer portion and a separate substantially semi-cylindrical fill-up portion.

2. Press stand according to claim 1, in which the bow-shaped portions of the yokes have substantially the same cross-section as the pillars between the yokes.

3. Press stand according to claim 1, which includes side plates fixing the fill-up portion to the stand.

* * * * *